United States Patent [19]

Tiede

[11] Patent Number: 4,702,186

[45] Date of Patent: Oct. 27, 1987

[54] SAILBOAT HAVING AT LEAST TWO HULLS

[75] Inventor: Helge Tiede, Hamburg, Fed. Rep. of Germany

[73] Assignee: Firma August Kuhne, Hamburg, Fed. Rep. of Germany

[21] Appl. No.: 18,725

[22] Filed: Feb. 24, 1987

Related U.S. Application Data

[63] Continuation of Ser. No. 733,882, May 14, 1985, abandoned.

[30] Foreign Application Priority Data

Oct. 17, 1984 [DE] Fed. Rep. of Germany ..... 3438063

[51] Int. Cl.[4] ..... B63B 1/12

[52] U.S. Cl. ..... 114/39; 114/61; 114/283

[58] Field of Search ..... 114/39, 61, 90–94, 114/102, 103, 123, 292, 283; 441/40, 44–46, 50, 53

[56] References Cited

U.S. PATENT DOCUMENTS

| | | | |
|---|---|---|---|
| 2,815,730 | 12/1957 | Horsdal | 114/56 |
| 3,247,821 | 4/1966 | Graig | 114/102 |
| 3,507,240 | 4/1970 | Butler | 114/90 |
| 3,656,445 | 4/1972 | Padwick | 114/61 |
| 4,002,132 | 1/1977 | Nitzki | 114/61 |
| 4,161,796 | 7/1979 | Kostanecki | 114/39 |
| 4,291,639 | 9/1981 | Burdick | 114/102 |
| 4,437,426 | 3/1984 | Latham | 114/39 |
| 4,498,409 | 2/1985 | Edel | 114/61 |

FOREIGN PATENT DOCUMENTS

| | | | |
|---|---|---|---|
| 1081063 | 12/1954 | France . | |
| 2068031 | 8/1971 | France . | |
| 2267233 | 4/1974 | France . | |
| 2478570 | 9/1981 | France . | |
| 2514718 | 4/1983 | France . | |
| 8105110 | 6/1983 | Netherlands | 114/93 |
| 792317 | 3/1958 | United Kingdom . | |

*Primary Examiner*—Joseph F. Peters, Jr.
*Assistant Examiner*—Stephen P. Avila
*Attorney, Agent, or Firm*—Fisher, Christen & Sabol

[57] ABSTRACT

In a sailboat having at least two hulls which are rigidly connected in parallel spaced arrangement by a platform, the hulls are provided at least at the bow with a bulge-shaped or drop-shaped design which runs into a wedge or blade shape astern. The lateral plan formed by the area of the longitudinal section of the hulls below the immersion level is such that the lateral point of gravity is shifted astern. For this purpose, the mast fixture is disposed in the rear half of the boat and, finally, the operating position is formed between the outer hulls and provided of the mast fixture.

6 Claims, 5 Drawing Figures

SAILBOAT HAVING AT LEAST TWO HULLS

This application is a continuation of application Ser. No. 733,882, filed May 14, 1985, now abandoned.

BACKGROUND OF THE INVENTION

The present invention relates to a sailboat having at least two hulls which are rigidly connected in spaced parallel arrangement by a platform or the like, and having a mast, a sail, and a rudder.

Known sailboats of the generic type involve the advantage of having greater stability but still weighing less than sailboats having only one hull. This also results in the further advantage of high sailing speed, which is evidenced in a particularly typical manner by that type of multi-hull boat which is designed as a twin-hull boat in the form of a catamaran, having two rigidly interconnected hulls and a mast with a sail attached midship.

The above-mentioned advantages of known sailboats of the generic type, however, are paid a high price for in the form of serious disadvantages. These include such facts as that a conventional twin-hull boat has considerable dimensions, in particular with respect to its width, and is also relatively difficult to maneuver for this reason. This poor maneuverability is increased by the typical cross-sectional shape of the hulls, which is knife-like throughout from stem to stern, thereby greatly impairing the maneuverability of the twin-hull boat as compared with a single-hull boat.

It is further peculiarity typical of such a known twin-hull boat that the danger of capsizing is great, especially at appreciable or relatively high wind speeds. Finally, the maneuverability of the known twin-hull boat is also impaired in proximity to land by the fact that the rudder blade and centerboard blade which protrude downwardly to an appreciable degree from the lower boundary edge of each hull make it impossible to go through shallow waters or make it necessary to bring up both the centerboard and the rudder in proximity to land and before running ashore.

The invention is therefore based on the problem of eliminating the disadvantages described by designing the sailboat of the generic type in such a way that it may be constructed with lesser width than is usual while still being more maneuverable, better protected against capsizing and allowing for higher sailing speeds.

SUMMARY OF THE INVENTION

In particular the hulls of the inventively designed sailboat have a special shape and a particular cross-section, namely, each hull has the shape of a bulge or drop at the bow or in its front area, which runs into a wedge or blade shape astern. Further, the lateral plan formed by the area of the longitudinal section of the hulls below the immersion level is designed in such a way that the lateral point of gravity is shifted astern. For this purpose, the mast fixture is disposed in the rear half of the boat. To compensate this, the position for operating the sailboat is shifted toward the stem, in such a way that it is formed between the outer hulls and disposed in front of the mast fixture.

It is of course possible to design the sailboat not only as a twin-hull boat but also with several, for example three, hulls. It corresponds in any case to a preferred embodiment to arrange the outer hulls of the boat so close together that the width of the boat is less than half the length of the boat. The special hull shape provided according to the invention in combination with the above-mentioned design thus make it possible to construct a multi-hull boat having considerably smaller dimensions of width than is usual. Whereas a conventional catamaran, for example, is usually designed with a length and width such that its width is approximately half its length, for example with a length of six meters and a width of three meters, it is possible to design the inventive twin-hull boat with a much smaller width. Thus, in the case of a practical embodiment of the invention, the length of the boat is four meters but the width of the boat is merely 1.50 meters. This considerable reduction in the dimensions results in particular advantages with respect to the manageability of the boat, whereby the above-mentioned dimensions of an embodiment realized in practice furthermore make it possible to transport the inventive twin-hull boat on the roof of a car in a simple manner.

According to a further feature of the invention, the sailboat may also be designed without a centerboard or a keel, i.e. in such a way that the hulls limit the deepest immersion level by their lower longitudinal edge. In this connection, the further embodiment of the inventive sailboat is also advantageous according to which the lower edge of its rudder blade is located on the level of the lower longitudinal edge of the hull, and arranged in particular in the horizontal alignment of the longitudinal center plane of the hull involved.

The area of transition between the bulge or drop-shaped portion of the hull and the blade-shaped portion of the hull is preferably located in the front half of the boat so that each hull has a wide and stout design in its front area, on the one hand, thereby producing relatively high buoyancy, but has a blade-shaped design in the remaining area and in particular in the rear area, on the other hand. This blade-shaped design of the hull acts in such a way as to prevent leeway beyond the usual degree, so that this blade-shaped design thus has an effect similar to that of a keel or centerboard without a keel or centerboard having to be provided, as mentioned.

Further advantages are obtained when the hulls of the sailboat are not designed with a constant height but when the height of the hulls increases from stem to stern, in such a way that the distance between the upper and lower boundary edges of the hulls becomes constantly larger astern. This allows, on the one hand, for a sufficiently large contact area to be obtained in the front area of the hulls due to their wide stout shape here, which results in the high buoyancy mentioned, and, on the other hand, for an enlarged blade-shaped immersion surface to be obtained in the rear area of the hulls due to the blade-shaped design provided here, thereby guaranteeing a considerable improvement in the maneuverability of the boat.

This increased maneuverability of the inventive sailboat is improved even further by prolonging the hulls at the stern beyond their vertical limit by adding a blade area which is triangular with an acute angle at the top. The rudder blade may be pivoted to this blade area of each hull, this being effected in such a way that each rudder blade extends as a whole on the same level as the hull involved. This advantageously makes it possible to run ashore anywhere and sail in shallow waters with the inventive sailboat without any need to bring up the rudder blade which otherwise protrudes downwardly.

The operating position arranged in front of the mast fixture and formed between the outer hulls in order to compensate the position of the mast shifted considerably astern, is designed in an expedient embodiment of the invention to such a way that the front part of the platform rigidly connecting the hulls forms the operating position and is designed in particular as a seat. It is also possible in this connection, in the case of sailboats which have a sufficiently large design, to form alternate operating positions in proximity to the rear area of the main operating position approximately laterally on each side of the mast fixture, in order to be able t provide the necessary balance of weight at high wind speeds by shifting one's body accordingly, or to have the possibility of conveying two or even three persons on the inventive sailboat.

The mast fixture disposed in the rear half of the boat is designed to have a height such that its top extends above the head of the person located in the operating position. This makes is possible for the mast, including the sail firmly connected thereto, to be rotated beyond an angle of 90°, or even by 360°, without endangering the person located in the operating position. This considerably increases the protection of the sailboat against capsizing since the sail can be accordingly veered out when necessary.

As set forth above, the lateral point of gravity is shifted as far as possible astern by correspondingly displacing the mast or mast fixture astern, this being compensated by shifting the operating position towards the stem between the outer hulls. This results in a striking increase in sailing speed accompanied by increased safety, in particular protection against capsizing. In a special embodiment, the bore in the mast fixture for taking up the mast is disposed at a point in the rear half of the boat which is spaced away from the rear end of the hull or the boat by about 40% to 30% of the length of the boat. The mast fixture may specifically be designed, for instance, with an anvil shape and an arm protruding freely astern, the arm of the mast fixture, or the boom attached to the mast, extending approximately as far as the end of the boat.

The mast and the boom are preferably designed in one piece or firmly interconnected, including stage bents attached to the upper end, so that the mast along with the boom, stage bents, sail and headsail can be rotated as one relatively rigid unit. The headsail (jib) has the shape of a narrow, elongated rectangle and is designed as a wind trimmer which is bent to the mast not only at both its ends but also at two, three or more points which are mutually spaced. This creates an advantageous nozzle effect with respect to the oncoming wind, whereby this effect can be varied as one chooses by adjusting the wind trimmer more or less tightly, but in any case ensures that the oncoming wind hits the mainsail at a higher speed, thereby producing higher suction and thus more forward thrust.

All in all, the inventively designed sailboat makes it possible not only to obtain higher sailing speed, improved protection against capsizing and greater maneuverability, but also to reduce the dimensions of width at the same time, thereby increasing the manageability of the boat, in particular during transport. The special hull shape provided in combination with the rearwardly shifted position of the mast and the contrasting location of the operating position in the front half of the boat between the hulls, further increase the stability of the boat while improving its sailing properties, without it being necessary any longer to provide a centerboard or a type of rudder blade which protrudes downwardly beyond the lower terminating plane of the hulls in order to prevent impermissibly high leeway. The rudder blade may actually be arranged advantageously, as set forth above, at the same height as the corresponding hull so that it is readily possible to sail in shallow waters and also to run ashore anywhere without it being necessary to bring up the rudder blade or draw up the centerboard.

The front hull area of the sailboat according to the invention ensures higher buoyancy due to its bulge or drop-shaped design, while the blade-shaped design of the remaining area of each hull provided after an appropriate transitional area prevents impermissible leeway and at the same time increases the maneuverability of the boat.

Further details and advantages of the present invention appear from the following description of a preferred embodiment shown schematically in the drawings.

DETAILED DESCRIPTION OF THE INVENTION

Figure 1:
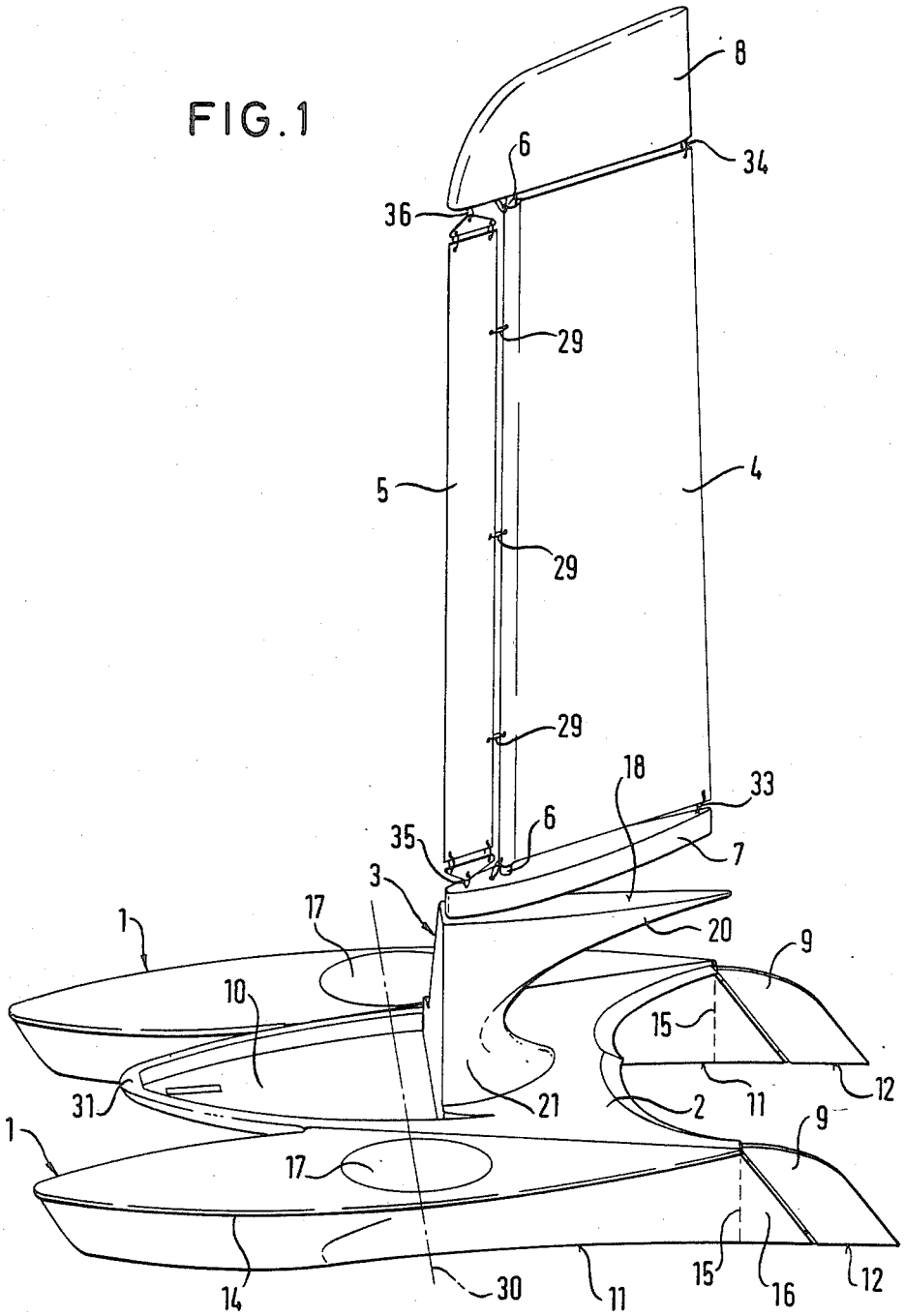
FIG. 1 is a perspective view of an inventive sailboat in the form of a twin-hull boat.

As can be seen in the drawing in detail, the sailboat shown exhibits two hulls 1 which are in spaced parallel arrangement and rigidly connected by a platform 2. To platform 2 a mast fixture 3 is attached on the longitudinal center plane of the boat, this mast fixture 3 serving as a pivot for a mast 6 provided with a mainsail 4 and a headsail 5.

Figure 2:
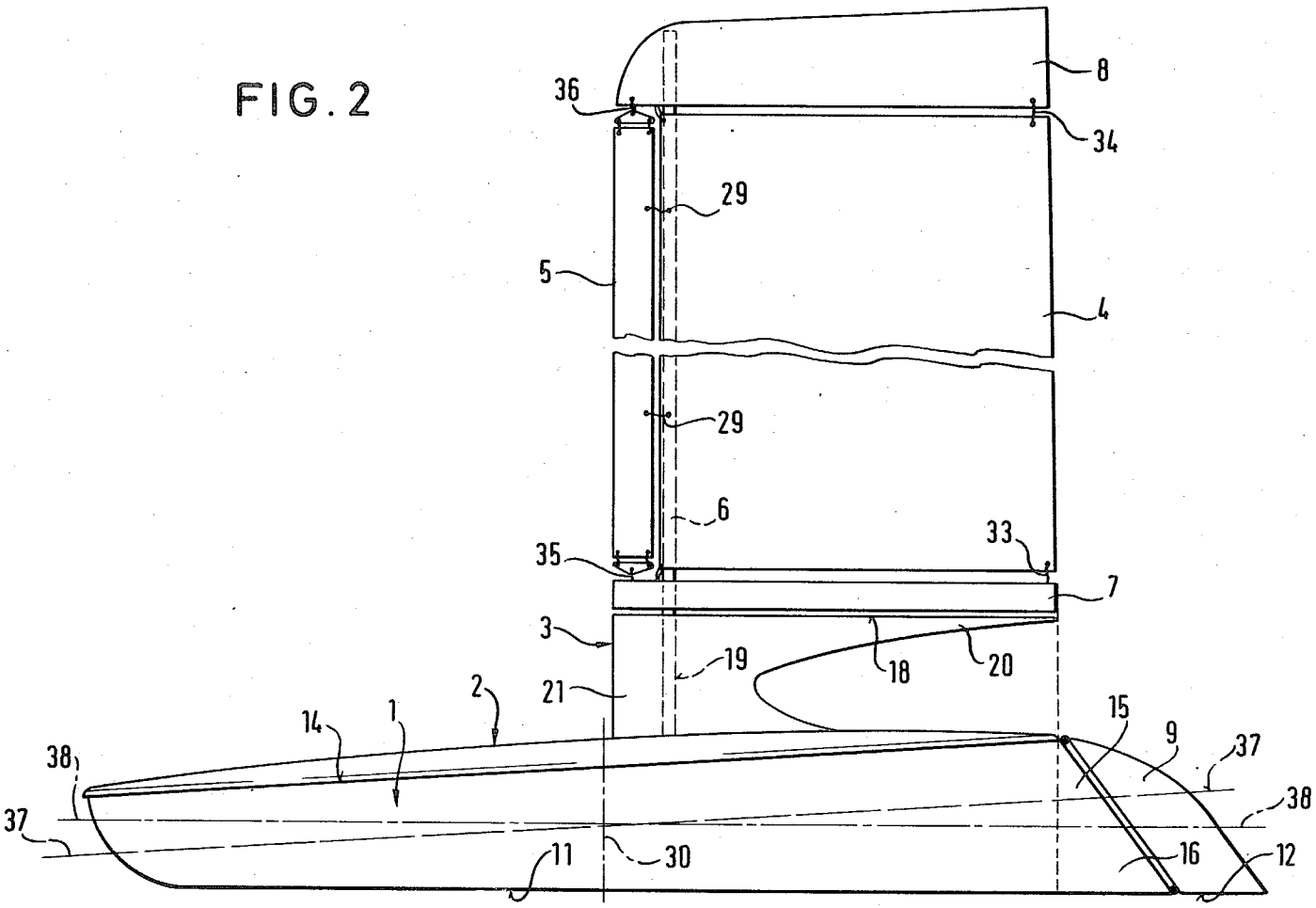
FIG. 2 is the twin-hull sailboat of FIG. 1 as seen from the side.
Figure 3:
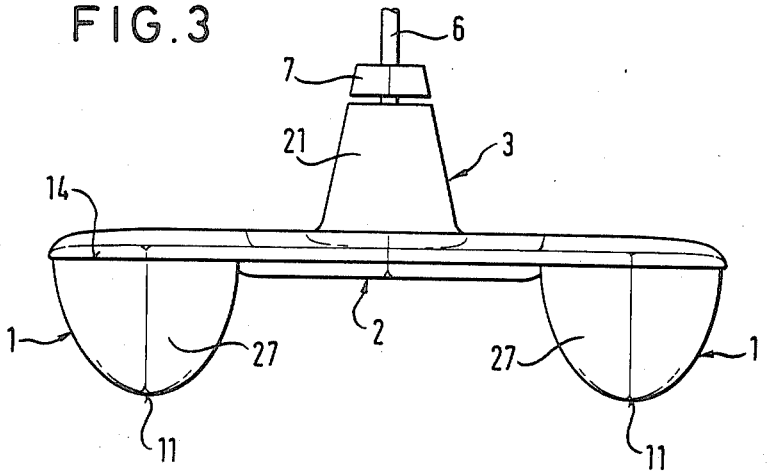
FIG. 3 is the twin-hull sailboat of FIG. 1 as seen from the front.
Figure 5:
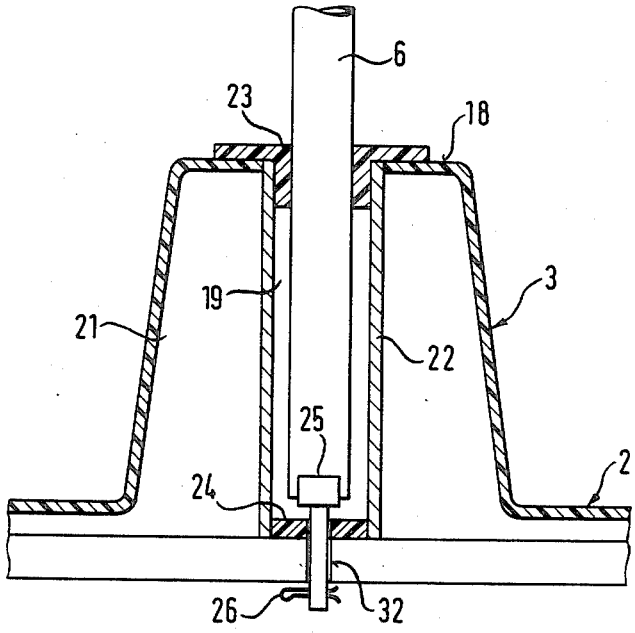
FIG. 5 is a detailed view of the mast fixture in cross-section, showing the pivoting of the lower end of the mast.
Figure 4:
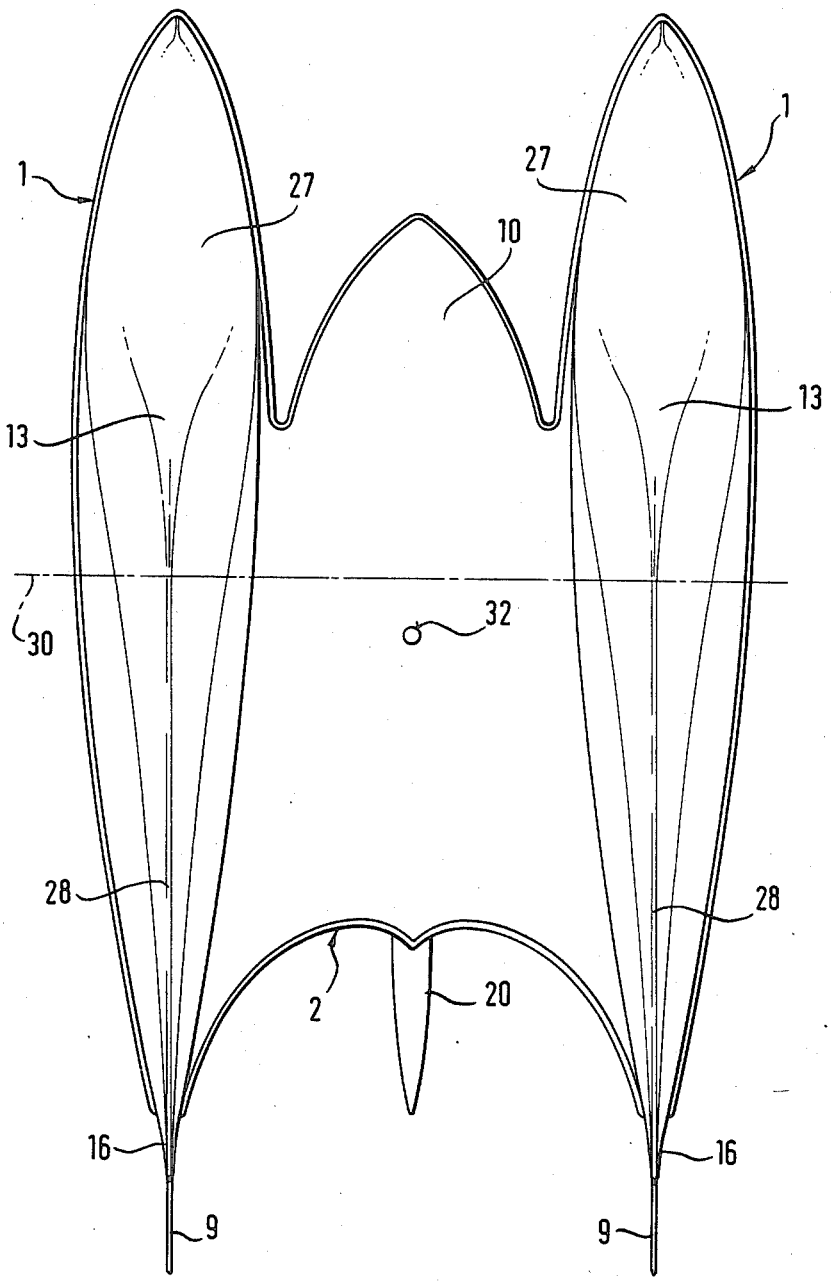
FIG. 4 is the twin-hull sailboat of FIG. 1 as seen form the bottom.

As shown particularly clearly in FIGS. 1, 3, and 4, the two hulls 1 of the boat exhibit a special shape or cross-sectional design, i.e. hulls 1 have a bulge or drop-shaped design 27 in the front area, this design 27 running into a wedge or blade shape 28 astern. The transitional area 13 between these two special shapes 27,28 of each hull is located in the front half of the boat which is bounded with respect to the rear half of the boat by transverse center line 38 indicated in FIGS. 1, 2 and 4.

As shown particularly clearly in FIGS. 1 and 2, the height of hulls 1 increases from stem to stern so that the distance between the lower boundary edge 11 of hulls 1 and the upper boundary edge 14, regarded from the side, becomes constantly larger astern.

The two hulls 1 are prolonged astern beyond their imaginary vertical boundary line 15, the prolonged portion also having the shape of a blade area 16. This blade area 16 is triangular with an acute angle at the top in each case. At the rear boundary edge of each blade area 16, a rudder blade 9 is pivoted which has the shape shown in FIGS. 1 and 2 and extends with its lower edge 12 on the level of the lower longitudinal edge 11 of the hull in such a way that rudder blade 9 is located entirely in the horizontal alignment of the longitudinal center plane of the hull 1 involved.

Since the sailboat shown is designed without a keel or a centerboard, as can be seen in the figures, and exhibits the special arrangement of each rudder blade 9 as described, the lower longitudinal edges 11 of hulls 1 form the deepest terminating plane of the boat.

As can be seen in FIG. 1, the two hulls 1 of the boat are arranged so close together that the width of the boat is less than half the length of the boat.

As described above, the lateral plan formed by the area of the longitudinal section of hulls 1 below the immersion level is designed in such a way that the lateral point of gravity is shifted altogether astern. For this purpose, mast fixture 3 is disposed in the rear half of the boat, a bore 19 in mast fixture 3 for taking up mast 6 being located in the embodiment shown at a point in the rear half of the boat limited by transverse center line 30, which point is spaced away from rear end 15 of the boat (imaginary vertical rear boundary edge 15 of each hull) by approximately 40% of the length of the boat.

The sailboat shown also exhibits an operating position 10 which is shifted towards the stem to compensate the position of mast 6 shifted far astern. This operating position 10 is located between the two hulls 1 in front of mast fixture 3. For this purpose, the front portion of the platform 2 is designed as an approximately triangular seat with a corresponding border 31. The arrangement is such that the horizontal top 18 of mast fixture 3 extends at a level higher than the head of the person located in operating position 10.

Mast fixture 3 has approximately the shape of an anvil having a base 21 and an arm 20 protruding freely therefrom astern and extending in the embodiment shown approximately as far as the end 15 of the boat. Base 21 of mast fixture 3 has a vertical bore 19 which mounts mast 6 in such a way that it can be freely rotated by 360°. For this purpose, bore 19 is lined with a sheath 22 which is sealed at its upper end by a bushing 23 and at its lower end by an abutment 24. Both bushing 23 and abutment 24 are made of synthetic material allowing for extremely easy slip so as to ensure that mast 6 can be rotated freely and readily. At the lower end of mast 6 there is a pivot pin 25 which penetrates a through hole 32 in platform 2 and protrudes downwardly. At this downwardly protruding end pivot pin 25 is provided with a split-pin 26 so that mast 6 is reliably protected against being drawn accidentally out of bore 19 in mast fixture 3.

As can be seen in FIGS. 1 and 2, mast 6 is arranged at a 90° angle to mast fixture 3 or to the horizontal top 18 of arm 20, and is firmly connected at its lower end with a boom 7 and at its upper end with stage bents 8. Mainsail 4 is bent to mast 6, on the one hand, and to at least two further points 33, 34 on boom 7 or on stage bents 8, on the other hand. Headsail 5 is bent a short distance in front of mainsail 4, headsail 5 having the shape of a narrow elongated rectangle, in the manner shown, and being designed as a wind trimmer. This wind trimmer 5 is connected at both its ends via points 35, 36 to boom 7 and stage bents 8, respectively, and bent to mast 6 via at least three further points 29.

Due to the specifically selected design such that boom 7 and top 18 of the arm 20 of mast fixture 3 are strictly parallel to each other, the entire relatively rigid unit consisting of mast 6, main boom 7, stage bents 8, mainsail 4 and headsail 5 can be freely rotated, and not only by an angle of 90° but altogether by 360°. This provides for extremely high protection against capsizing and furthermore makes it unnecessary to add shrouds, permanent backstays or forestays. Finally, the fact that the plane or rotation of boom 7 is higher than the head of the person located in operating position 10 ensures that this operating person is not endangered.

As can also be seen in FIG. 1, alternate operating positions 17 are formed laterally beside operating position 10 which are located on each side of mast fixture 3 and may serve to take up further persons or else the person located in main operating position 10 if a shift of weight or balance of weight should become necessary at higher wind speeds.

The sailboat shown has a degree of maneuverability which considerably superior to that of a conventional catamaran or even to that of a conventional single-hull sailboat, which is due not only to the specific design of the hull or hull cross-section but also to a considerable extent to the fact that no centerboard or rudder blade surface is provided so as to protrude downwardly beyond the terminating plane formed by lower longitudinal edge 11 of hulls 1.

As also indicated in FIG. 2, the sailboat shown exhibits an immersion level which varies according to the prevailing wind speed.

Two different immersion levels 37, 38 are indicated in FIG. 2 merely by way of example, whereby immersion level 37 holds for wind speed 1, for example, and is such that the front bulge-shaped or drop-shaped portions 27 of hulls 1 are immersed relatively little in the water, whereas the wedge-shaped or blade-shaped portions 28 in the rear hull area are immersed relatively deep in the water. By contrast, immersion level 38 is such, at wind speed 3 or 4, for example, that the wide and stout hull area 27 at the front is now immersed more deeply in the water, while at the same time the rear blade-shaped hull area 28 is raised somewhat but, due to the specific overall design of the hull, is only raised to the extent that the overall immersed lateral area of the hull constantly remains approximately the same.

What is claimed is:

1. A sailboat having a float body, a mast, and an operating position forward of said mast, comprising:

said float body comprising at least two hulls rigidly connected in spaced relationship and tapering in cross-section from a drop-shaped portion at the bow to a blade-shaped portion astern;

each of said hulls having a lateral area formed by the area of the longitudinal section of the hulls below the immersion level being such that the lateral point of gravity of said sailboat is displaced rearwardly behind the center of said sailboat;

mast fixture means for supporting said mast in the rear half of said sailboat; and each of said hulls having a height increasing from stem to stern to form an upper boundary edge of said hulls that is inclined upwardly astern such that a lower boundary edge of said hulls extends parallel to the immersion level.

2. A sailboat as claimed in claim 1 wherein the width of said sailboat is less than half of the length of said sailboat.

3. A sailboat as claimed in claim 1 wherein the transitional area between said drop-shaped portion and said blade-shaped portion is located in the front half of said sailboat.

4. A sailboat as claimed in claim 1 wherein said lower boundary edge of said hulls is prolonged at the stern in relation to said upper boundary edge to form a triangular blade area having an acute angle adjacent said upper boundary edge.

5. A sailboat as claimed in claim 4 further comprising a rudder blade pivoted on each of said triangular blade areas at the stern of each of said hulls.

6. A sailboat as claimed in claim 1 further comprising said mast fixture means having a bore for receiving the mast and said mast fixture means being positioned in a spaced relationship from the rear end of said hulls by approximately 30–40 percent of the length of said sailboat.

* * * * *